US007121464B2

(12) United States Patent
White

(10) Patent No.: US 7,121,464 B2
(45) Date of Patent: Oct. 17, 2006

(54) AUTOMATED PROJECTILE DELIVERY SYSTEM

(76) Inventor: Thompkins W. White, 3852 Hidden Waters Trail, Tallahassee, FL (US) 32309

( * ) Notice: Subject to any disclaimer, the term of this patent is extended or adjusted under 35 U.S.C. 154(b) by 660 days.

(21) Appl. No.: 10/447,636

(22) Filed: May 29, 2003

(65) Prior Publication Data

US 2004/0241622 A1 Dec. 2, 2004

(51) Int. Cl.
*G06F 19/00* (2006.01)

(52) U.S. Cl. ..... 235/400; 434/16; 434/17; 434/19; 434/21; 434/23; 434/27

(58) Field of Classification Search ..... 235/400; 434/16, 17, 19, 21, 23, 27
See application file for complete search history.

(56) References Cited

U.S. PATENT DOCUMENTS

| | | | | |
|---|---|---|---|---|
| 1,438,833 | A | 12/1922 | Kaminski | |
| 3,711,638 | A | 1/1973 | Davies | |
| 4,205,589 | A | 6/1980 | Engler et al. | |
| 4,256,013 | A | 3/1981 | Quitadama | |
| 5,206,452 | A | 4/1993 | Stamper et al. | |
| 5,215,464 | A * | 6/1993 | Marshall et al. | 434/22 |
| 5,471,213 | A | 11/1995 | Hergesheimer | |
| 5,954,507 | A | 9/1999 | Rod et al. | |
| 6,283,034 | B1 | 9/2001 | Miles, Jr. | |
| 6,386,879 | B1 | 5/2002 | Varshneya | |
| 6,549,872 | B1 * | 4/2003 | Bollweg et al. | 434/22 |
| 2004/0009798 | A1 * | 1/2004 | Okuda et al. | 463/7 |
| 2004/0033472 | A1 * | 2/2004 | Varshneya | 434/23 |
| 2005/0178373 | A1 * | 8/2005 | Hatcher | 124/31 |

* cited by examiner

*Primary Examiner*—Thien M. Le
*Assistant Examiner*—Allyson N Trail
(74) *Attorney, Agent, or Firm*—John Wiley Horton

(57) ABSTRACT

A system for precisely timing the firing of two or more weapons in order to create a desired arrival timing of two or more projectiles on a target. Global Positioning System ("GPS") transceivers are used to determine the position of each weapon and report that position to a command post. Heading-to-target and ranging information is also preferably transmitted so that the command post is able to accurately fix the position of the target, and the range of each weapon to the target. Computations are then performed in order to determine the firing sequence needed to achieve a desired arrival of two or more projectiles on the target. Firing of the weapons is then performed automatically in order to properly execute the computed firing sequence. Interactive command and control data is fed back and forth between the weapons and the command post.

22 Claims, 11 Drawing Sheets

AUTOMATED PROJECTILE DELIVERY SYSTEM

BACKGROUND OF THE INVENTION

1. Field of the Invention

This invention relates to the field of projectile delivery systems. More specifically, the invention comprises an integrated weapon control system which precisely times the firing of two or more weapons in order to create a desired projectile delivery sequence at a target.

2. Description of the Related Art

The term "projectile delivery system" includes small devices, such as rifles fired by individuals, and large devices, such as howitzers. Such weapons are typically fired individually, though they may be aimed to concentrate their fire on a single target. Some automated firing systems have been developed to fire such weapons simultaneously. However, as the range to target may vary for the different weapons, simultaneous firing of the weapons will typically not result in all the projectiles striking the target at the same time.

In many instances it is desirable to have all the projectiles strike a designated target or targets simultaneously. A simultaneous strike may be needed to achieve complete surprise. A hostage situation is a good example of the need for a simultaneous strike. FIG. 9 shows a hostage situation. Two targets 104 are in close proximity to three hostages 102. It is desirable to strike both targets simultaneously. This goal is difficult to achieve, however, since the range to target for first rifle 110, second rifle 112, third rifle 114, and fourth rifle 116 are all different. The reader should appreciate that the illustration—in order to fit all the individuals in a single view—is unrealistically compressed. It is not uncommon for one rifle to be within 50 meters of a target while another might be 200 meters further away. This displacement can result in displaced arrival times for the projectiles approaching ½ second, well within human reaction time. In order to achieve a desired arrival of two or more projectiles, it is therefore necessary to precisely sequence the firing of the weapons that launch them.

BRIEF SUMMARY OF THE INVENTION

The present invention comprises a system for precisely timing the firing of two or more weapons in order to create a desired arrival timing of two or more projectiles on a target. Global Positioning System ("GPS") transceivers are used to determine the position of each weapon and report that position to a command post. Heading-to-target and ranging information is also preferably transmitted so that the command post is able to accurately fix the position of the target, and the range of each weapon to the target. Computations are then performed in order to determine the firing sequence needed to achieve a desired arrival of two or more projectiles on the target. Firing of the weapons is then performed automatically in order to properly execute the computed firing sequence. Interactive command and control data is fed back and forth between the weapons and the command post.

REFERENCE NUMERALS IN THE DRAWINGS

| | | | |
|---|---|---|---|
| 10 | rifle | 12 | stock |
| 14 | receiver | 16 | barrel |
| 18 | video scope | 20 | trigger |
| 22 | GPS antenna | 24 | bolt |
| 26 | bolt handle | 28 | firing mechanism |
| 30 | shroud | 32 | striker nut |
| 34 | electromechanical actuator | 36 | selector lever |
| 38 | electrical firing position | 40 | mechanical firing position |
| 42 | safe position | 44 | sear |
| 46 | sear notch | 48 | recoil pad |
| 50 | upper bay | 52 | lower bay |
| 54 | power supply | 56 | electronics module |
| 58 | conduit | 60 | multi-lead cable |
| 62 | connector | 64 | trigger guard/magazine assembly |
| 65 | main harness | 66 | trigger harness |
| 68 | scope harness | 70 | R/F antenna harness |
| 72 | basic control box | 74 | R/F antenna |
| 76 | rotary switch | 78 | on-target indicator |
| 80 | No-Go indicator | 82 | armed indicator |
| 84 | remote fire trigger | 86 | auto fire panel |
| 88 | auto fire switch | 90 | power switch |
| 92 | advanced control box | 94 | video display |
| 96 | status indicator | 98 | tactical display |
| 100 | touch screen display | 102 | hostage |
| 104 | target | 106 | wall |
| 108 | window | 110 | first rifle |
| 112 | second rifle | 114 | third rifle |
| 116 | fourth rifle | 118 | first trajectory |
| 120 | second trajectory | 122 | third trajectory |
| 124 | fourth trajectory | 126 | command post |
| 128 | heading | 130 | inclination |

DESCRIPTION OF THE INVENTION

Figure 1:
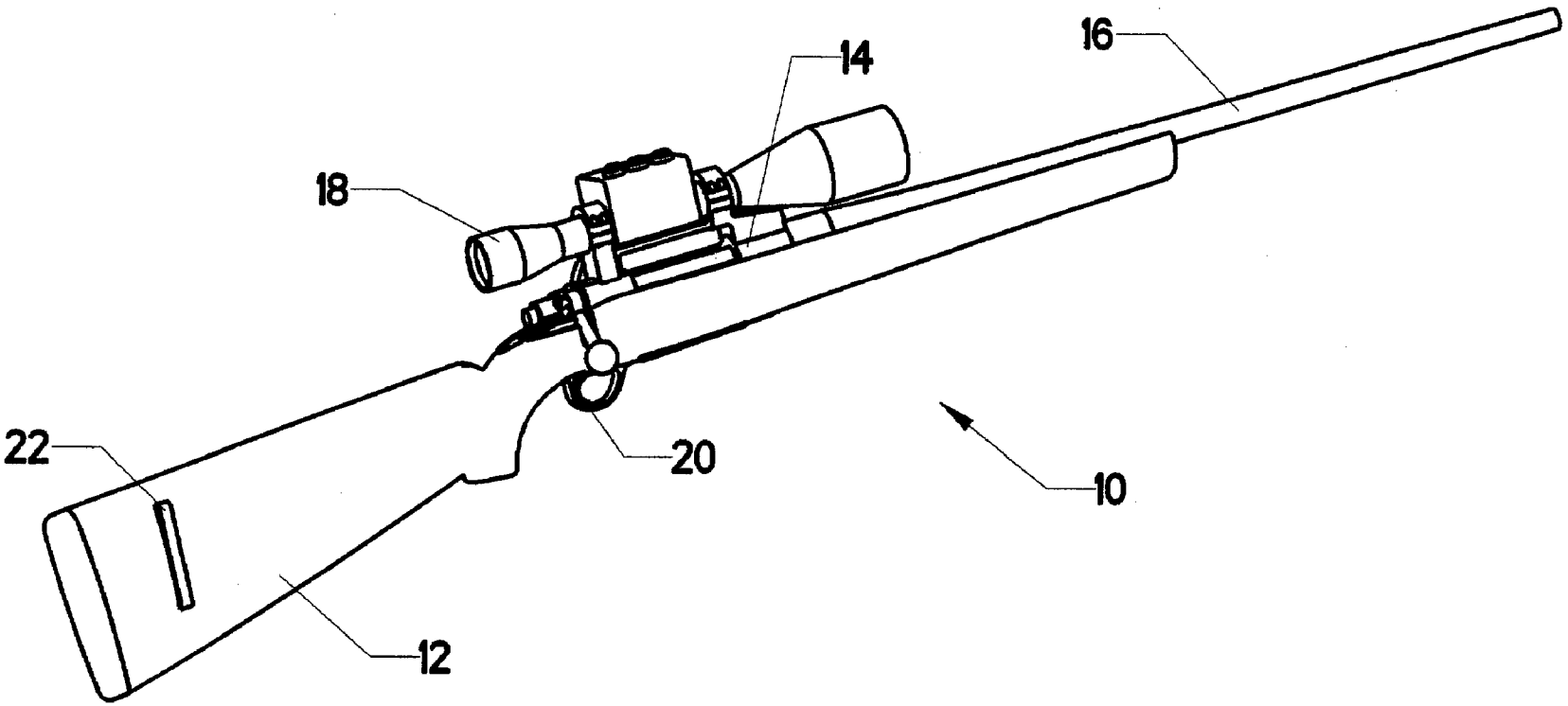
FIG. 1 is an isometric view, showing a rifle equipped according to the present invention.

The present invention is primarily intended to be carried out using rifles carried and fired by individuals such as those found in a tactical response team. FIG. 1 shows rifle 10, which generally consists of a barrel 16 locked into a receiver 14, with a stock 12 providing a grip for a user. Trigger 20 is provided for firing the weapon. Videoscope 18 is provided for aiming the weapon. Videoscope 18 has other features as well. It includes a camera which forms and transmits an image corresponding to the shooter's view through the scope. It also includes a laser rangefinder that is capable of determining a distance to the target (More on this subject will be presented subsequently).

Figure 2:
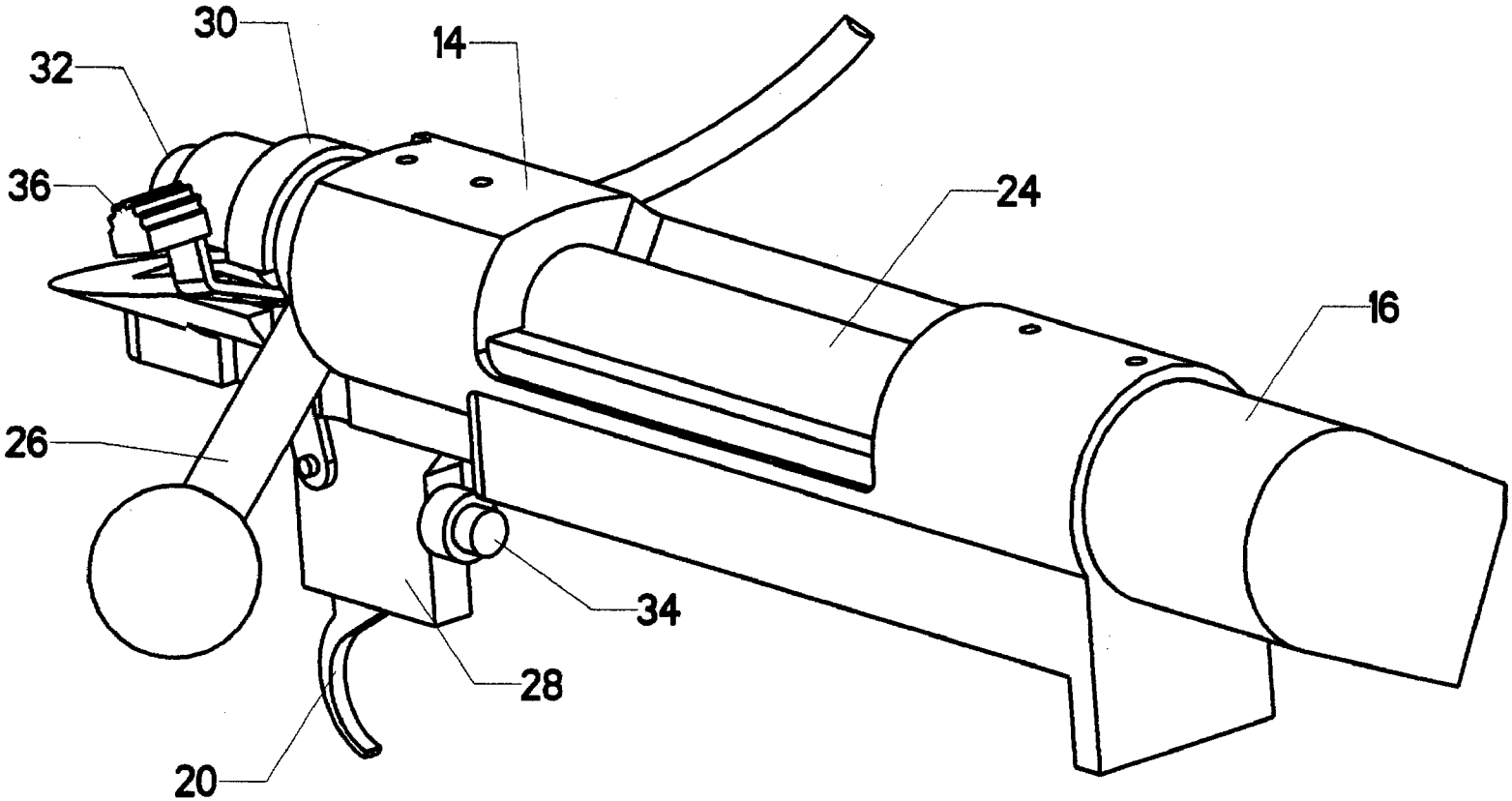
FIG. 2 is an isometric view, showing a rifle equipped with an electromechanical trigger.

FIG. 2 is a detail view showing portions of rifle 10. Videoscope 18, stock 12, and other components have been removed for purposes of visual clarity. Receiver 14 houses bolt 24. Bolt handle 26 is provided to allow the operator to manipulate bolt 24 in the loading and ejection of cartridges. Shroud 30 and striker nut 32 move with bolt 24. Firing mechanism 28 attaches to the bottom of receiver 14. Trigger 20 extends out the bottom of firing mechanism 28. Electromechanical actuator 34 is mounted on the front of firing mechanism 28. Selector 36 is pivotally mounted to the side of firing mechanism 28. Its upper portion extends out to the side of shroud 30, where it can be manipulated by the user's thumb or fingers into various positions.

Figure 3:
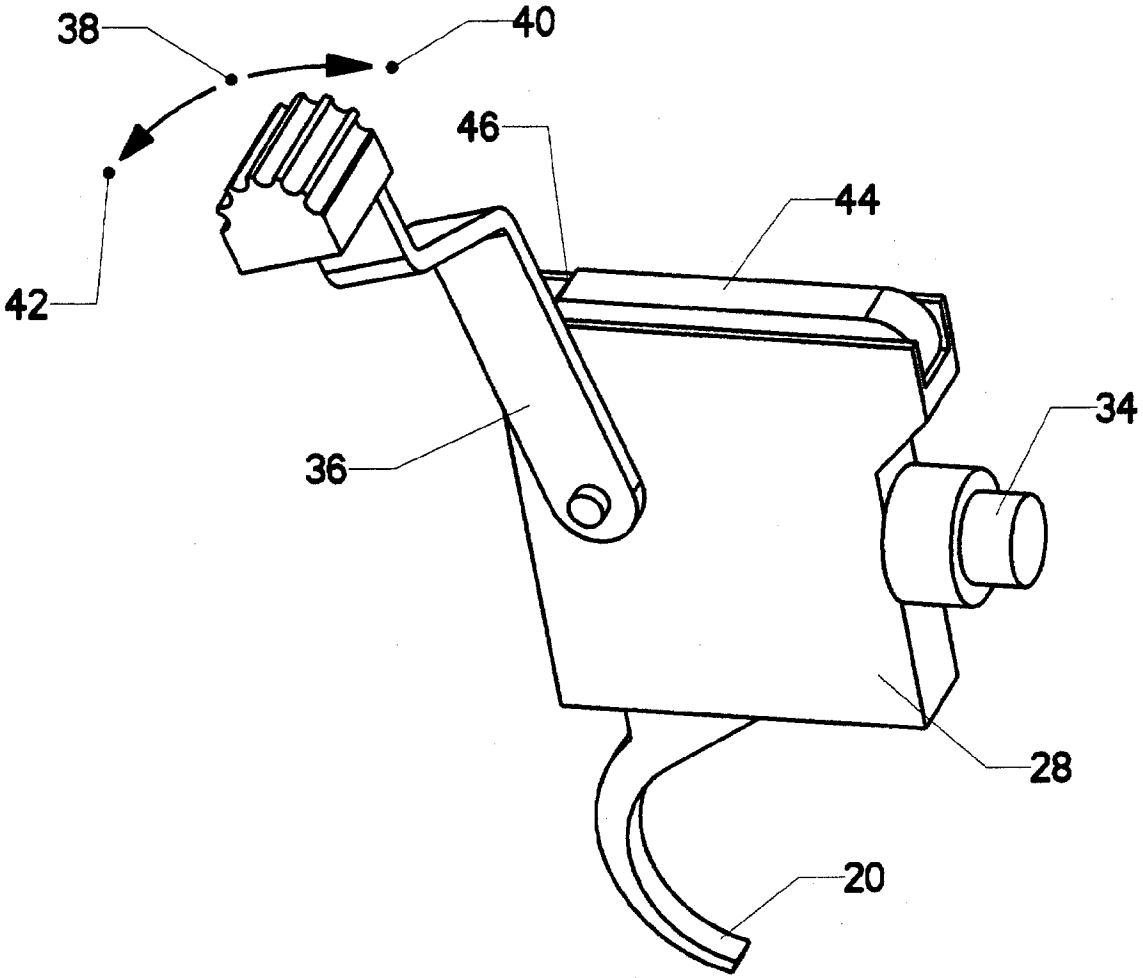
FIG. 3 is an isometric view, showing the electromechanical trigger in detail.

FIG. 3 shows firing mechanism 28 in more detail. Sear 44 extends out its upper extremity. As those skilled in the art will know, sear notch 46 engages with a stepped surface on the bottom of the striker nut in order to hold the firing striker in the cocked position. When sear 44 pivots downward, sear notch 46 will disengage from the striker nut, allowing the striker to slam forward and detonate a cartridge in the rifle's chamber. In a conventional trigger mechanism, the firing action is actuated by simply pulling trigger 20. The version shown in FIG. 3 incorporates additional features.

Electromechanical actuator 34 is installed in the forward portion of the mechanism. Rather than being directly connected to the sear, trigger 20 controls only an electrical switch. Selector lever 36 is pivotally moved between safe position 42, electrical firing position 38, and mechanical firing position 40. When selector lever 36 is in safe position 42, the weapon will not fire. When selector lever 36 is in electrical firing position 38, the unit is set to receive a fire signal from a remote command post. When in this state, trigger 20 is used as an "enabling" feature. The user points the rifle at the target. So long as the rifle is on target, the user depresses trigger 20. If the fire signal is received at that point, the weapon will fire. If the fire signal is received when trigger 20 is not depressed, the weapon will not fire. Thus, in order for the weapon to fire when selector lever 36 is in the electrical firing position, trigger 20 must be depressed and a fire signal must be received.

In some instances, the user will want to use the rifle conventionally with no control by a remote command post. In such a situation, the user moves selector lever 36 to mechanical firing position 40. In this position, the rifle will fire as soon as trigger 20 is depressed. The term "mechanical firing position" is used to indicate that the weapon can be fired by simply squeezing the trigger. For the specific embodiment described, an electrical circuit is obviously involved. Selector lever 36 can be used as a conventional safety by moving it rearward to safe position 42.

Figure 4:
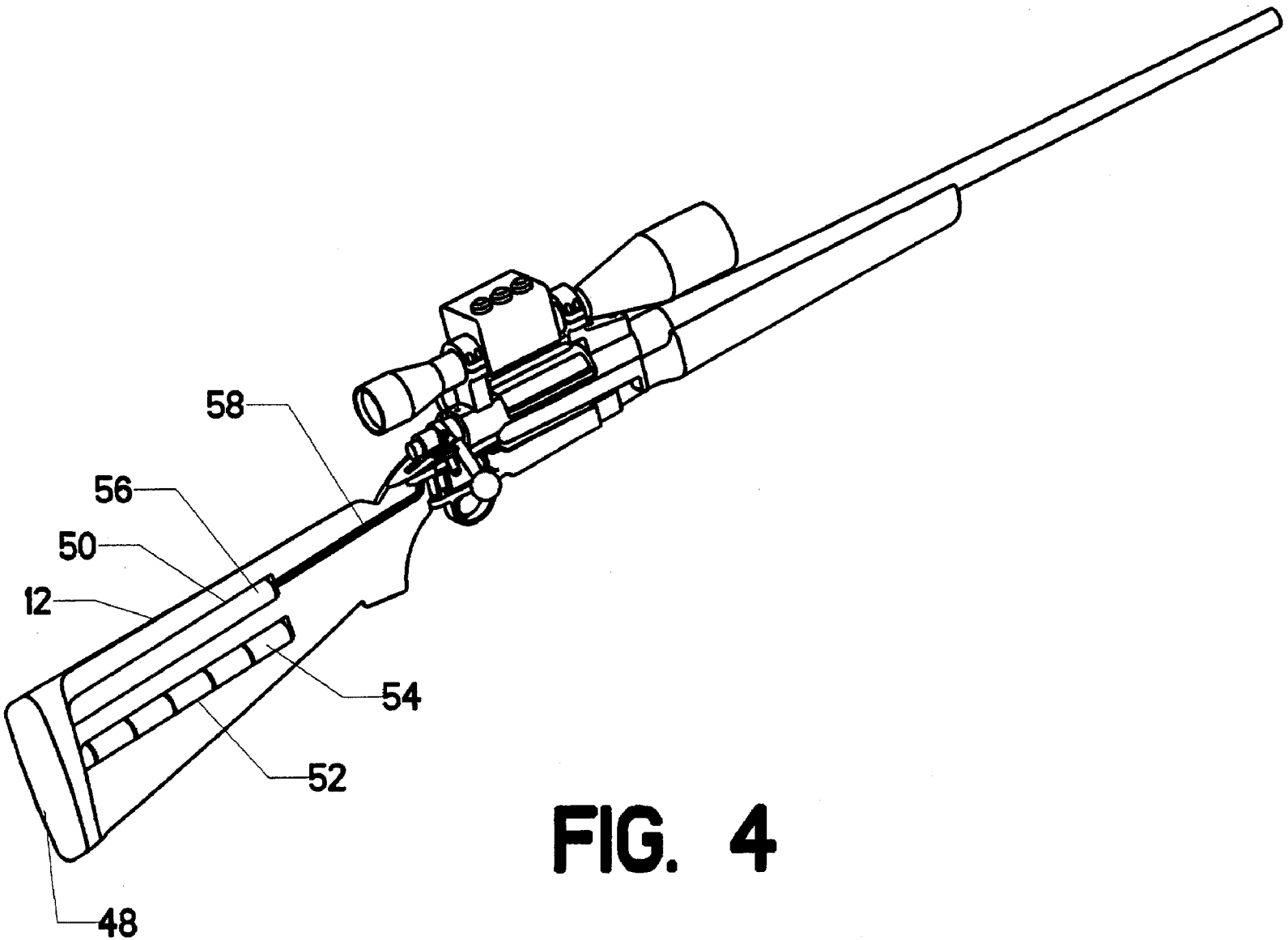
FIG. 4 is an isometric view with a cutaway, showing the internal details of a rifle equipped according to the present invention.

FIG. 4 shows a rifle according to the present invention with a cutaway through the stock to reveal internal features. Two cylindrical cavities are included in the butt portion of stock 12. These cavities are accessed from the rear by removing recoil pad 48. Upper bay 50 contains electronics module 56. Lower bay 52 contains power supply 54, which is electrically connected to electronics module 56 through a conduit just beneath recoil pad 48 (not shown). Power supply 54 can assume many forms, but is generally a set of storage batteries with voltage and current regulating features.

Electronics module 56 includes: a radio frequency ("R/F") transmitter and receiver, a global position system ("GPS") receiver, an electronic compass (indicating the precise heading of the weapon), and a microcomputer for processing data transmitted by and to the rifle. These devices are preferably housed within a sturdy and shock-resistant cylinder sized to fit within upper bay 50. Returning briefly to FIG. 1, GPS antenna 22 is preferably provided on an external surface of stock 12. It is connected via an internal passage to electronics module 56. The use of such an antenna enhances the accuracy of the GPS receiver.

Figure 5:
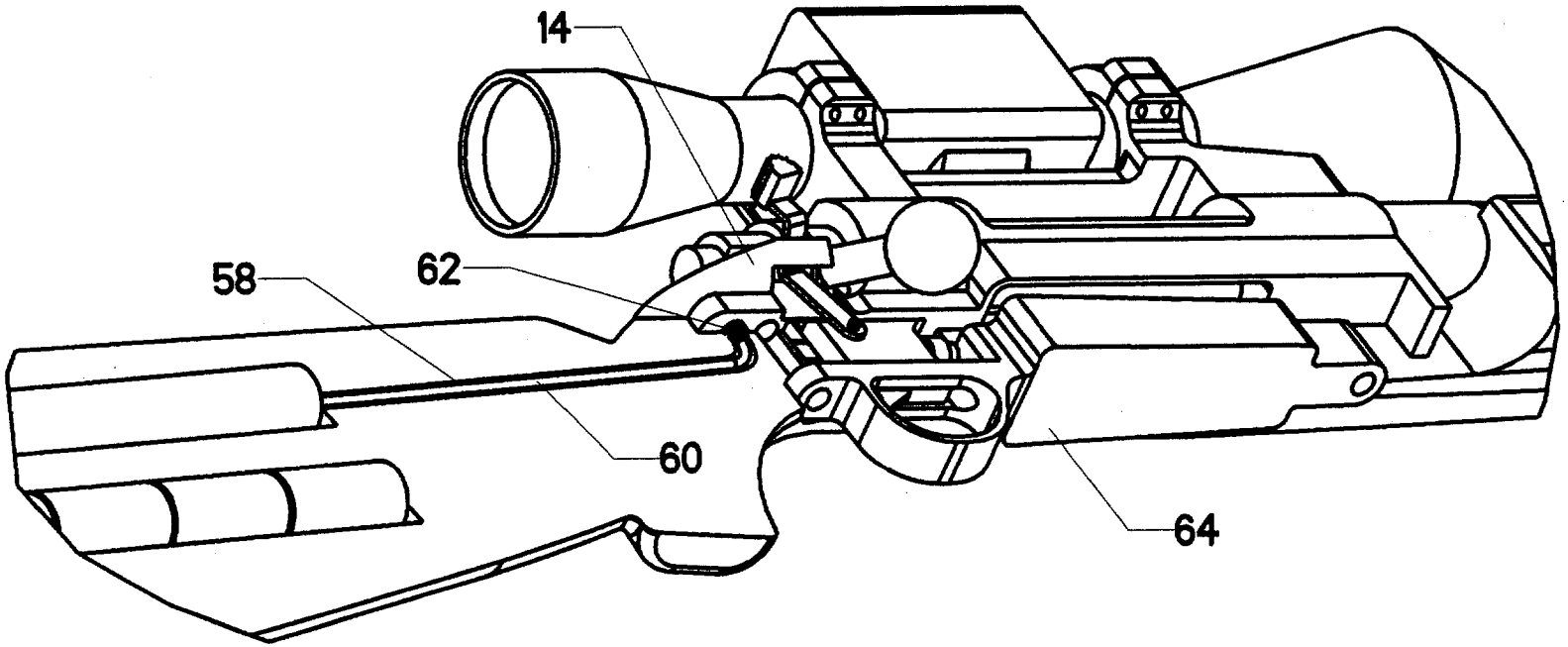
FIG. 5 is an isometric detail view, showing more details of a rifle.

Returning now to FIG. 4, the reader will observe that upper bay 50 is connected to receiver 14 via conduit 58. FIG. 5 shows this feature in more detail. Conduit 58 houses multi-lead cable 60, which connects electronics module 56 to connector 62 on the underside of receiver 14. In this view, the reader will observe the position of trigger guard/magazine assembly 64, as well as the position of firing mechanism 28 and selector lever 36. Multi-lead cable 60 is a bundle of insulated electrical wires. It is important for numerous connections to be made between electronics module 56 and the rest of the rifle, as will be explained subsequently. Those skilled in the art will realize that this multi-lead cable could be replaced by a data bus.

Figure 6:
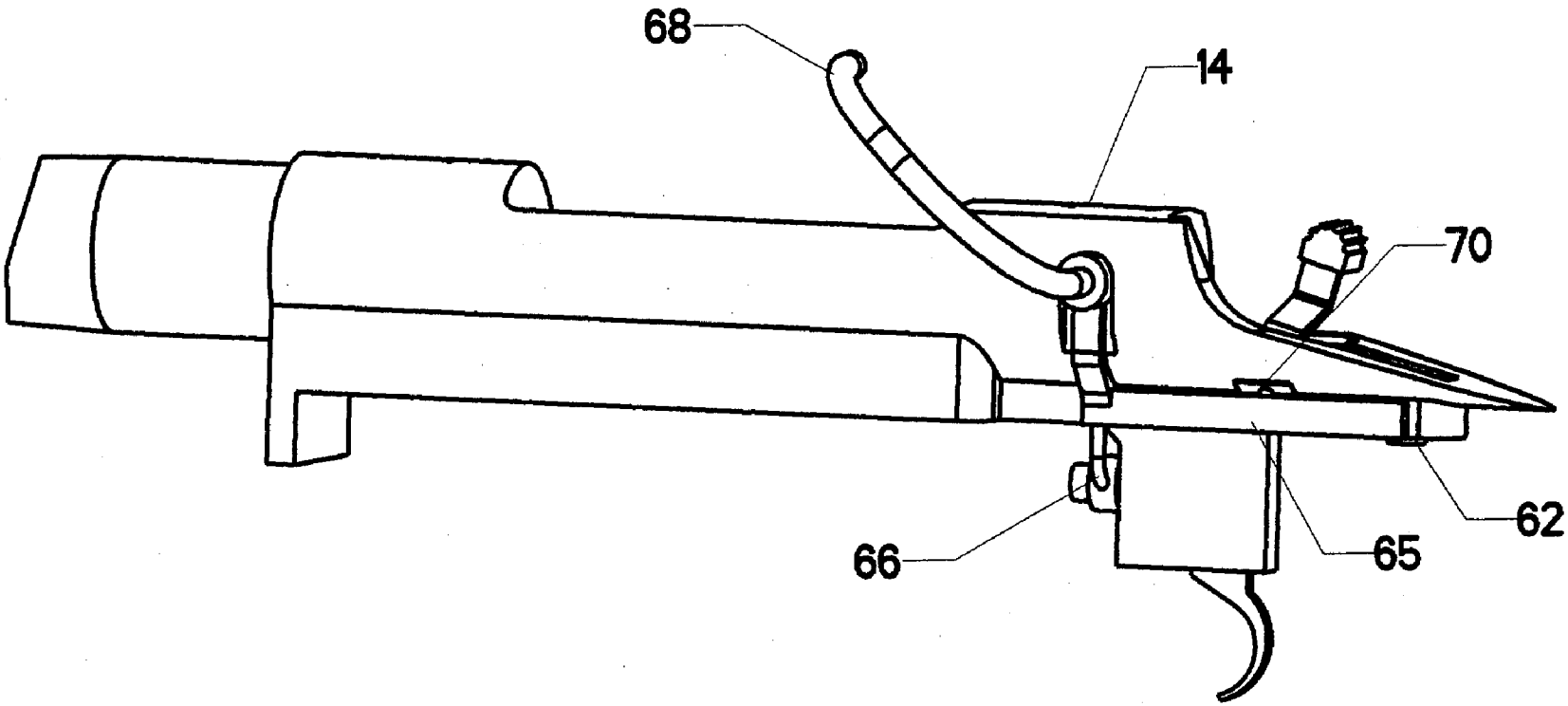
FIG. 6 is an isometric view, showing a wiring harness used on a rifle.

FIG. 6 shows more of the electrical connections within the rifle. Main harness 65 runs along the lower left side of receiver 14 (here the term "harness" is used to describe a group of electrical connectors). It is preferably a three-dimensional molded circuit board, containing a number of separately insulated connectors. Scope harness 68 is connected to the upper portion of main harness 65. Trigger harness 66 is connected to the lower portion of main harness 65. Scope harness 68 electrically connects videoscope 18 to main harness 65, and ultimately to electronics module 56. Likewise, trigger harness 66 connects firing mechanism 28 to main harness 65 and electronics module 56.

Because the rifle sends and receives R/F data, the use of an antenna is desirable. The combination of barrel 16 and receiver 14 (which are typically locked together via a threaded engagement) makes a good antenna. R/F antenna harness 70 electrically connects a portion of main harness 65 to receiver 14. This lone contact is electrically insulated from the other circuits. It provides an electrical connection between electronics module 56 and the antenna assembly comprised of barrel 16 and receiver 14.

Reviewing FIGS. 4–6, then, the basic operation of a rifle equipped according to the present invention can be understood. For a remote firing scenario, the user switches on the electronics and moves selector lever 36 to electrical firing position 38. He or she then aims through videoscope 18 in order to put the rifle on target. Videoscope 18 sends video data through scope harness 68, main harness 65, and multi-lead cable 60 to electronics module 56. When the rifle is on target, the user depresses trigger 20. This action makes an electrical contact, and that information is transmitted through trigger harness 66 and ultimately on to electronics module 56.

The reader will recall that electronics module 56 also contains a GPS receiver and electronic compass. These known devices compute the position of the rifle and the direction in which it is pointed ("heading").

Electronics module 56 processes the video data, trigger status, rifle position, and rifle heading information. It converts these to an R/F signal and transmits them back through multi-lead cable 60 to main harness 65. They are then sent through R/F antenna harness 70. The barrel/receiver assembly then functions as an antenna and transmits the video image, trigger status, rifle position, and rifle heading information to a remote location.

Figure 7:
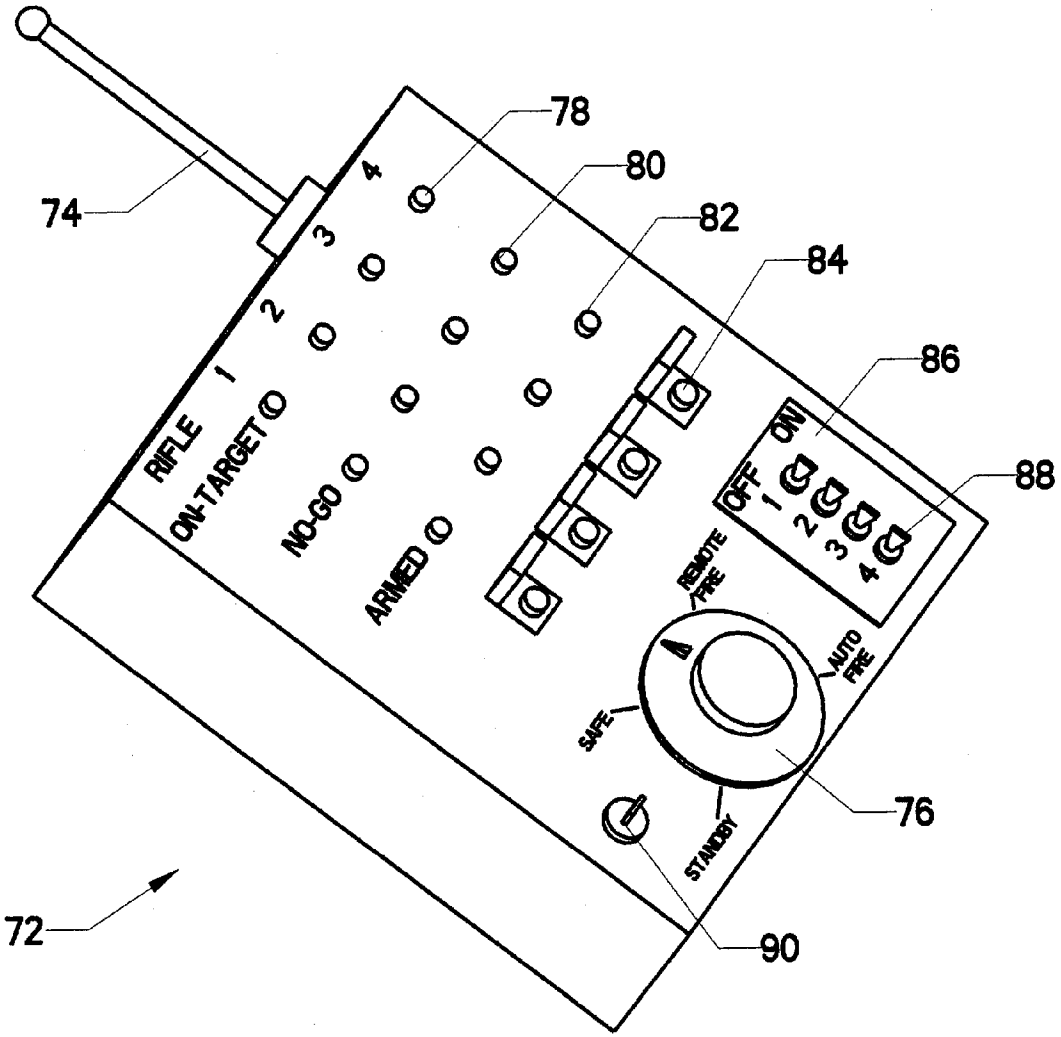
FIG. 7 is an isometric view, showing a basic control box.

A control station is needed to command several rifles. This control station can assume many forms. FIG. 7 shows a simplified version, designated as basic control box 72. Basic control box 72 is small enough to be held in two hands. Antenna 74 receives and transmits R/F signals to the rifle. A set of indicator lights is provided across the top of the device. For the version shown, a maximum of four rifles are controlled (Those skilled in the art will realize that a version controlling 5 or more rifles could also be made).

The lowest row of lights comprise armed indicators 82. These lights illuminate for a particular rifle when that rifle's selector lever 36 has been placed in electrical firing position 38, meaning that the rifle's remote firing capability has been activated. The middle and upper row of lights indicate whether a particular rifle is on target and ready to fire. If the rifle is not on target or is otherwise not ready to fire (perhaps because of an intervening obstruction), no-go indicator 80 will illuminate. Once the rifle is on target and ready to fire, the shooter depresses trigger 20. No-go indicator 80 will then go out and on-target indicator 78 will illuminate. Different colors can be used for the different indicators. One example would be using green for the on-target indicators, red for the no-go indicators, and amber for the armed indicators.

At the very bottom of the device is power switch 90, which may assume the form of a rotary lock requiring a key. It switches on and off all functions. Just to the right of this device is a large rotary switch 76. Rotary switch 76 can be turned to one of four positions. These are: (1) Standby; (2) Safe; (3) Remote Fire; and (4) Auto Fire. In the "Standby" position, the circuitry remains active but no signals are sent or received. All the indicator lights are switched off. In the "Safe" position, signals are transmitted and received and the indicator lights are illuminated. However, it is not possible to fire any of the weapons.

In the "Remote Fire" position, the user is able to remotely fire one or more of the rifles (explained in further detail subsequently). In the "Auto Fire" position, control circuits are used to automatically fire the rifles once a set of predetermined parameters is satisfied. Auto fire panel 86 only comes into play if rotary switch 76 is placed in the Auto Fire position. It allows the auto fire capabilities for each rifle to be turned on or off using auto fire switches 88.

If rotary switch 76 is placed in the Remote Fire position, the user can selectively fire one or more of the rifles by pressing the appropriate remote fire trigger 84. These buttons are preferably covered by a safety hatch, as shown. The safety hatch would remain over the buttons until just before firing. Basic control box 72 performs a variety of other functions, which will be described in detail once an explanation of the entire context in which the devices are used has been provided.

Figure 8:
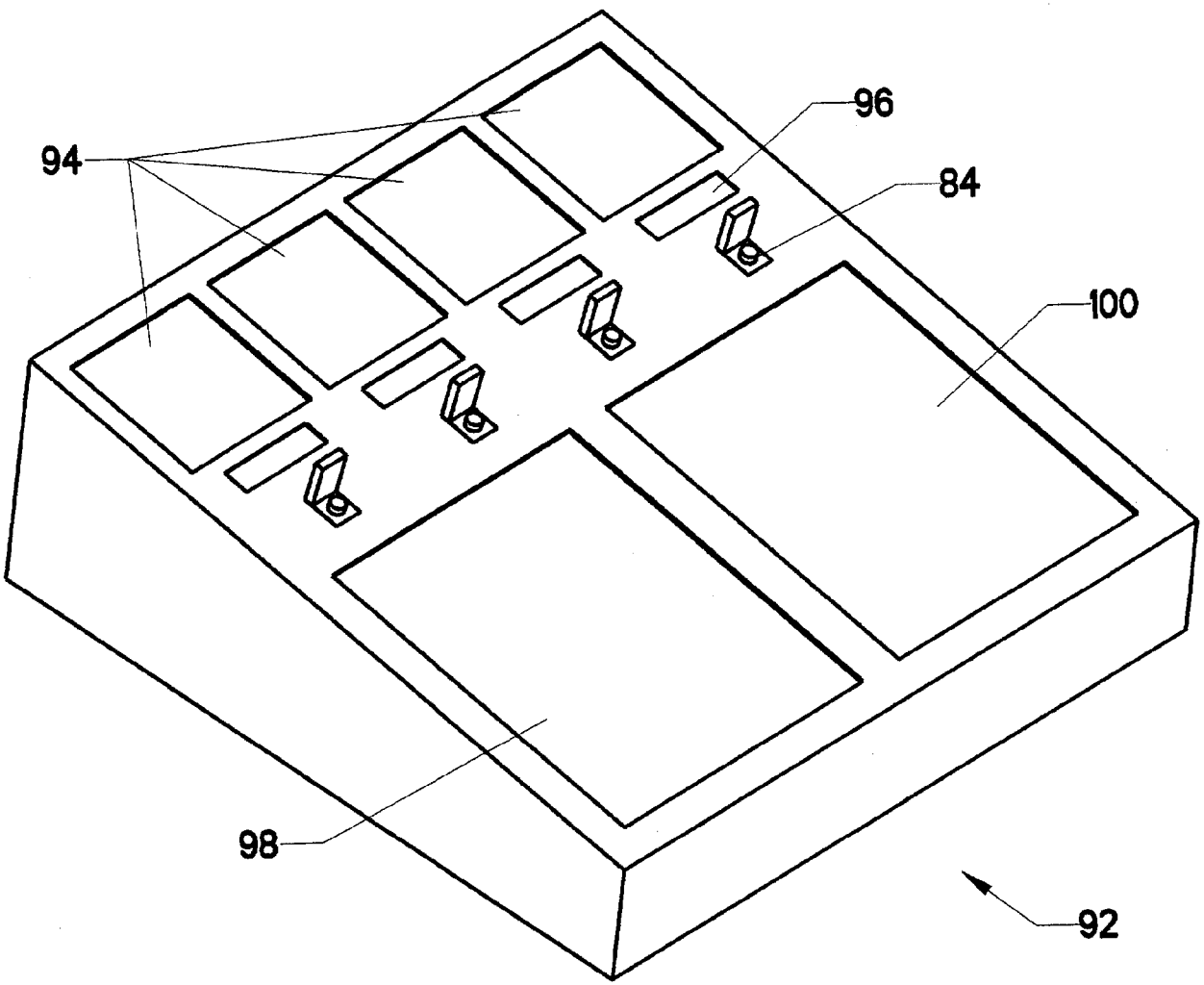
FIG. 8 is an isometric view, showing an advanced control box.

Those skilled in the art will realize that modern user interface systems have gone well beyond the type shown for basic control box 72. FIG. 8 shows advanced control box 92, which incorporates additional interfaces. This device is the size of a small console. The version illustrated is intended for use with four rifles, though a version controlling five or more rifles could obviously be made. Four video displays 94 are arrayed across the top of the console. These display the video feeds from each of the four videoscopes 18 on the four rifles. Thus, the scene commander is able to observe exactly what the shooters are observing through their videoscopes. Just beneath each video display 94 is a status indicator 96. Each of these replaces the three lighted indicators used in basic control box 72. It textually displays the status of each rifle by displaying "ARMED," "NO-GO," and "ON-TARGET" messages. These are typically done using a back-lit LCD display. The display may also be set to change colors for each message. Again, as an example, "ARMED" could be amber, "NO-GO" could be red, and "ON-TARGET" could be green.

Below the status indicators is a row of remote fire triggers 84. These are used to remotely fire individual rifles. As for basic control box 72, they are preferably guarded by hatch covers or similar devices.

The primary user interface is provided by touch screen display 100. It provides a set of graphical menus for the user to select. The menus (which are displayed in a Windows-style format familiar to contemporary computer users) guide the user through processes carried out by the advanced control box. The user makes selections and enters data within the menus by touching the screen at a "pick-box" location. Alternatively, a pointing device such as an external mouse can be provided. A keyboard or numerical pad can also be provided. A computer is used to control all the functions of advanced control box 92, including the displays.

Tactical display 98 is provided to the left of touch screen display 100. Both touch screen display 100 and tactical display 98 are typically back-lit LCD's similar to those used in "notebook" computers. They are capable of displaying color graphics and text of a very high resolution. Tactical display 98 shows the position of all rifles. It can also show the position of targets, hostages, and other features relevant to the scene. Geographical Information System ("GIS") data can be loaded into the control box and displayed on tactical display 98. Such GIS data typically includes street map overlays and satellite or aerial imagery.

The operation of the devices described previously is best explained using an example. As explained previously, FIG. 9 shows a hostage situation. The scene is compressed substantially in order to show all the participants in a single view. The building in the upper right contains three hostages 102 being held by two targets 104. In an attempt to hit the two targets, the scene commander must consider the position of the doors and windows, as well as the hostages themselves. He or she must also consider the desired position for each shooter. In the scene depicted, the scene commander has placed first rifle 110, second rifle 112, third rifle 114, and fourth rifle 116 as shown. Each is positioned to be able to fire through a window.

Advanced control box 92 is placed at command post 126 (which happens to be near one of the rifles, though this need not be the case). Advanced control box 92 receives GPS position data from each of the rifles. The GPS system employed is preferably equipped with the Wide Area Augmentation System ("WAAS"), which can obtain stand-alone positional accuracy of about 3 meters. In some instances, even greater accuracy will be desired. In that case, a reference GPS receiver is placed near the scene at a known point. GIS (Geographical Information Systems) data includes highly accurate position information for building corners, light pole positions, and other similar commonly-available reference points. A reference GPS receiver can be placed on such a point. As the GPS satellites orbit, small variations in computed positions are typical for stand-alone GPS receivers. All GPS receivers in the same area tend to experience the same variations. The reference GPS receiver (which is stationary at a known position) is used to cancel out these variations. As those skilled in the art will know, the incorporation of a reference GPS receiver allows the computed positional accuracy of other GPS receivers in the vicinity to be reduced to several centimeters. The use of such a system is now common in the field of surveying. Thus, through the use of a reference GPS receiver, advanced control box 92 "knows" the position of all four rifles within a few centimeters. Each position is displayed to the scene commander on tactical display 98.

Conventional radio voice communications are typically maintained between the scene commander and each shooter (common in the prior art). The scene commander would typically assign a target for each shooter using verbal instructions. In some instances, the scene commander may assign two or more shooters to a single target in order to achieve redundancy (and for other purposes to be subsequently explained). Thus, for each rifle, one target of the group of targets represents a "designated" target.

It is important for the operation of the present invention that the range from each rifle to its designated target be known. The range can be computed using several methods. First, videoscope 18 may incorporate a laser rangefinder. These devices, which are known in the art, use a projected laser and interferometric principles to compute the range to a target. This range information is displayed to the shooter in the videoscope and it can be transmitted via R/F signal to advanced control box 92. However, those skilled in the art will also know that laser range finders sometimes produce false reading when looking through glass. If the glass is dirty (thereby producing laser backscatter on its surface), the laser rangefinder may report the range to the glass panel rather than the target lying beyond it. For this reason, a second range finding method is also employed.

Figure 9:
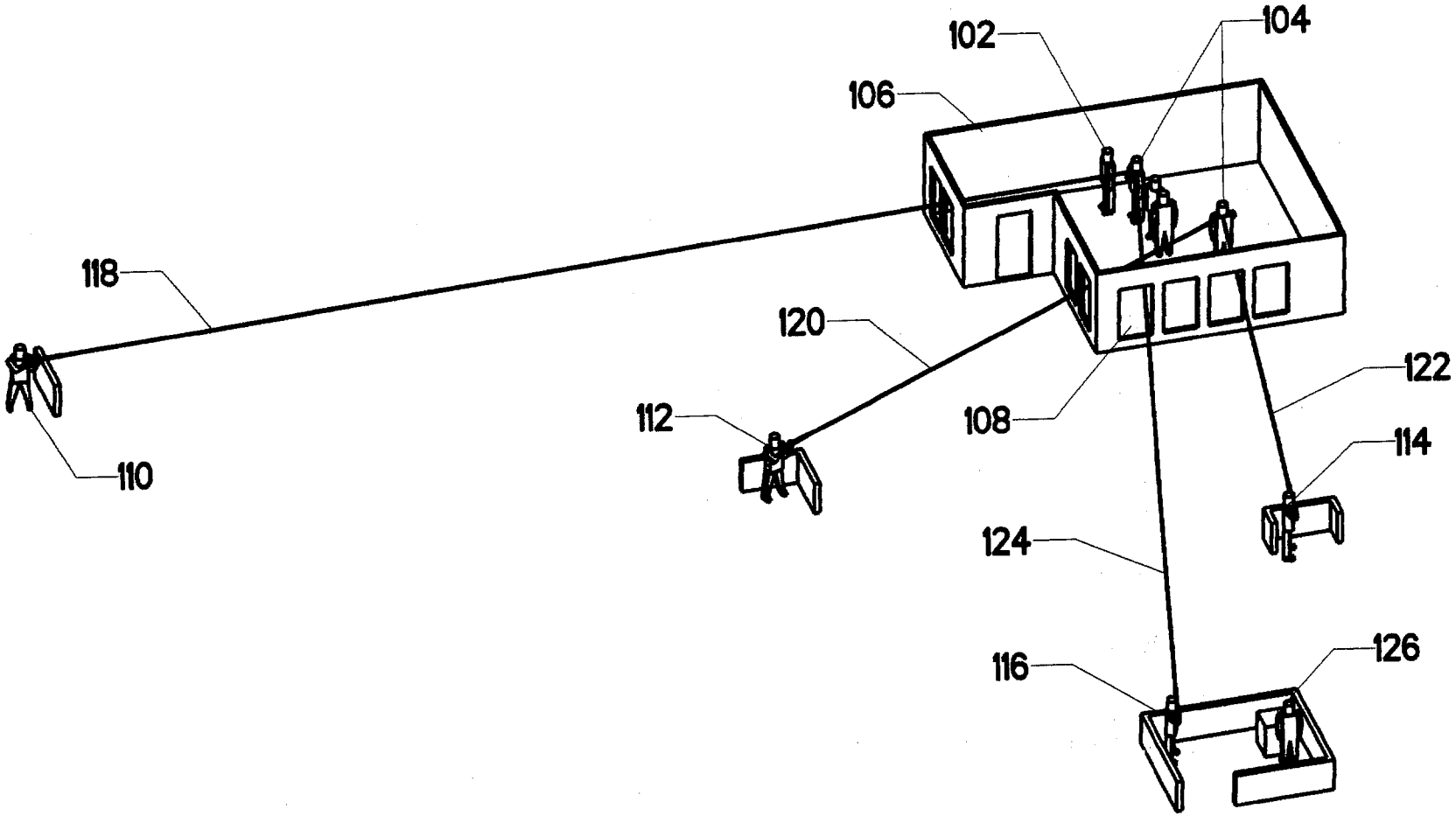
FIG. 9 is an isometric view, showing the use of the invention in a hostage situation.
Figure 10:
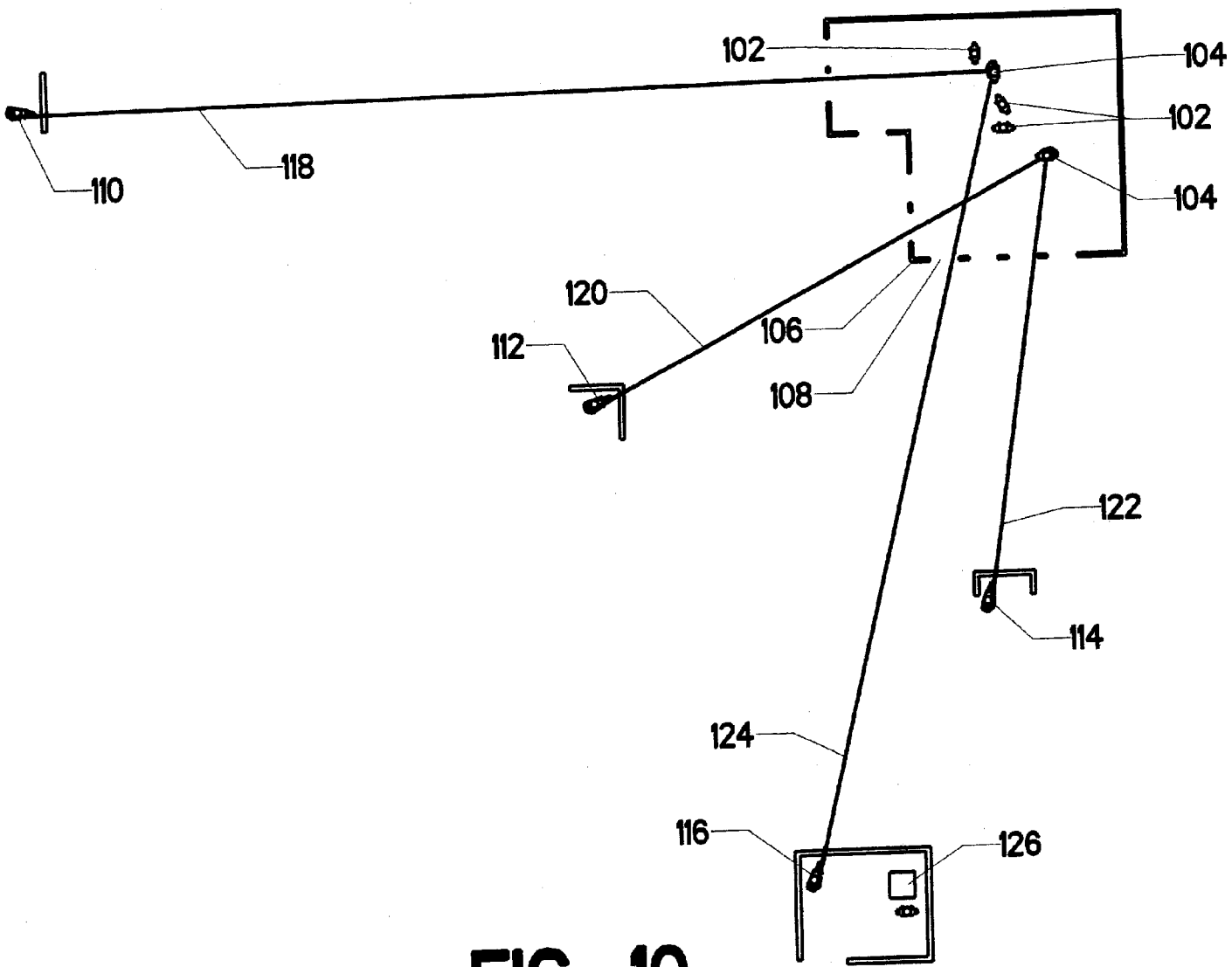
FIG. 10 is a plan view, showing the use of the invention in a hostage situation.

FIG. 10 shows a plan view of the same scene depicted in FIG. 9. As mentioned previously, advanced control box 92 receives continuously updated position data for each of the rifles. It also receives continuously updated heading data for each of the rifles. Using principles of triangulation, this information can be used to compute the range from each rifle to its target. A computer is provided within the control box for manipulating the data and performing the computations.

An example is helpful: First rifle 110 occupies position (X1, Y1). The heading of first rifle 110 lies along first trajectory 118, which is aimed to hit target 104. Assuming that north is toward the top of the page in the view, first trajectory 118 is on a heading of 88 degrees (using the conventional system of true north being zero degrees and counting upward in the clockwise direction).

Fourth rifle 116 occupies a position (X4, Y4) and is trained on the same target 104 as first rifle 110. Fourth trajectory 124 is on a heading of 11 degrees. The origin point of both first trajectory 118 and fourth trajectory 124 is known, since the position of each rifle is known. The angular heading information can then be used to determine the point at which the two trajectories intersect (commonly referred to as "triangulation"). This intersection point will be the position of the northern target 104. The same method can be used to determine the position of the southern target 104. These computations are updated continuously using a fast clock cycle. Thus, the computer within the control box is constantly determining position data for all four rifles and the two targets 104 it is then a simple matter to determine the range from each rifle to its designated target. This range information can be checked against range information provided by the laser rangefinders in order to verify its accuracy. If the two range values are close, then there is a good indication of accuracy. If, on the other hand, the laser information suggests a far shorter range to target than the triangulation computations, then there is a suggestion that the laser data represents the range to an intervening glass panel rather than to the target.

The depiction shown in FIG. 10 is actually a good representation of what is preferably shown on tactical display 98 of advanced control box 92. Continuing the example of the hostage situation depicted in FIGS. 9 and 10, assume the scene commander has decided that the shooters are to engage both targets simultaneously. Further assume that he or she has decided that a minimum of two rifles must be trained on each target before the order to fire will be given. Another goal is to have all the projectiles strike their targets simultaneously. The commander inputs these parameters into advanced control box 92 using the aforementioned user interface. The commander then selects the "Auto Fire" function.

At this point, the computer calculates the range-to-target for each rifle. Next, it computes a time-in-flight for each projectile. It then computes a staged firing sequence which is required to place all the projectiles at their respective targets at the same instant. In the example shown, first rifle 110 must be fired first, followed by fourth rifle 116, second rifle 112, and third rifle 114. The delay between each rifle-specific firing command is computed so that all the projectiles strike their targets simultaneously. Of course, the other parameters are considered as well. The computer will not issue the firing sequence until all four shooters have depressed their triggers to indicate that they are "on-target" and have a clear field of fire.

The example presented is but one of many possibilities for using the system. As a second example—It is well known to rifle shooters that striking and punching through a glass window will alter a bullet's trajectory. While some compensation is possible, this phenomenon degrades accuracy whenever a target is a significant distance beyond the glass pane. The present invention can be used to reduce this concern. Employing the user interface, the scene commander can assign second rifle 112 and fourth rifle 116 to be "glass breakers." These two rifles would be loaded with flat-nosed solid bullets. They can be aimed a bit higher to avoid striking an unintended target (obviously on a different trajectory than the one shown in the view). The computer then times the firing sequence to have a solid bullet fired by a "glass breaker" strike the glass pane about 25 milliseconds ahead of the conventional bullet aimed at the target. The "glass breaker" punches a hole through the glass so the target bullet can pass through unaffected. The firing sequence can then have the two target bullets arrive at their respective targets simultaneously.

Numerous other sequences are possible. In some instances, the scene commander might want to have a first bullet reach its target 10 milliseconds ahead of a second bullet, and so on. Those skilled in the art will also realize that many more rifles can be controlled by such a system. Six rifles could be employed, with one "glass breaker" punching a hole allowing two target bullets to pass through.

Additional refinements are likewise possible. In most situations, only the heading of each rifle will need to be considered. In other situations, however, the incline of the rifle will need to be considered (such as when one shooter is substantially above the rest). In artillery parlance the terms used are "azimuth" and "elevation," with "azimuth" referring to the heading and "elevation" referring to the incline of the rifle. A digital inclinometer can be installed on each rifle in order to provide precise incline data which can be transmitted back to advanced control box 92. Altitude data would also be fed by the GPS system within each rifle. The incline data would be combined with the heading data in order to perform three-dimensional triangulation computations.

Figure 11:
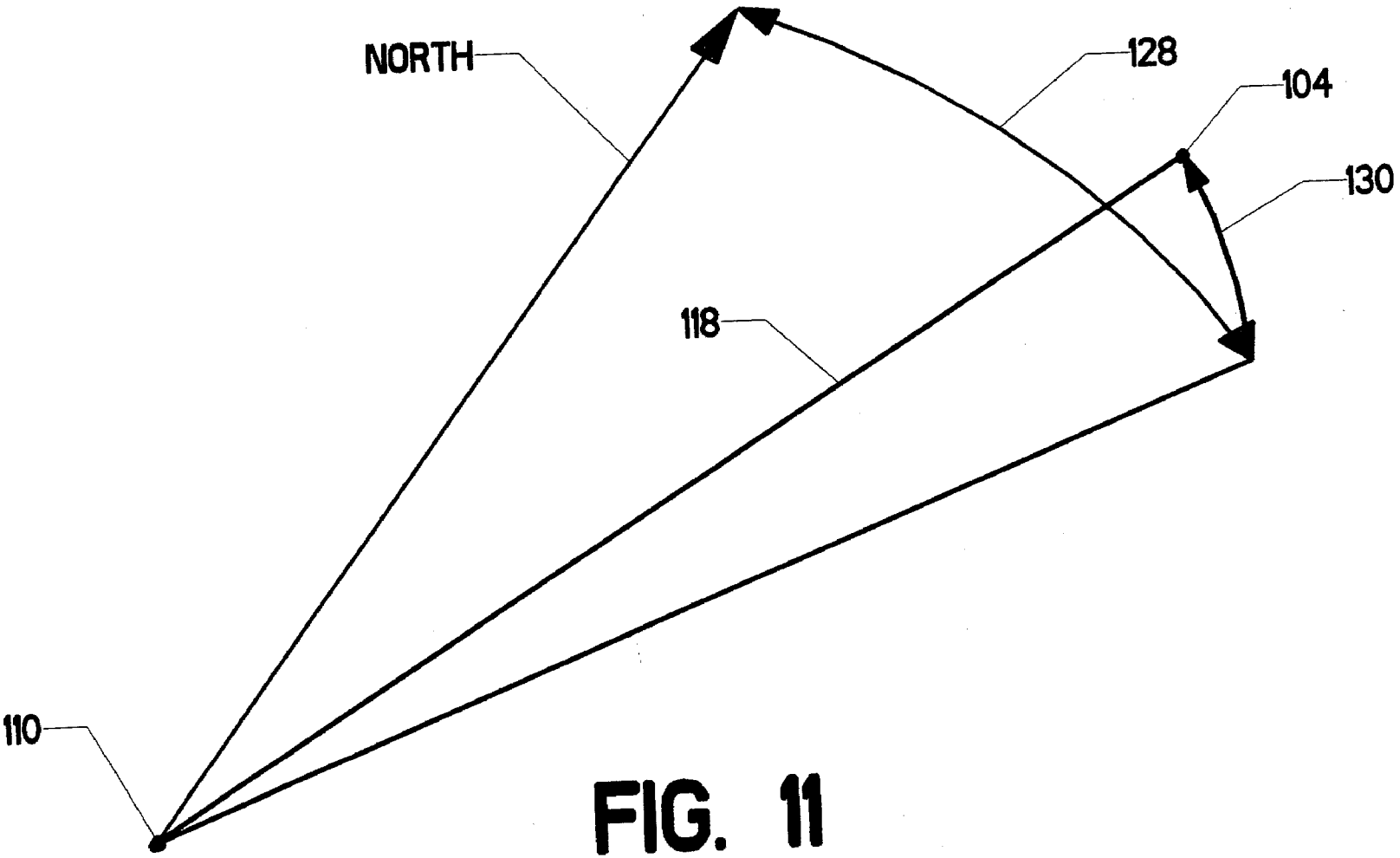
FIG. 11 is an isometric view, illustrating the use of heading and inclination data.

FIG. 11 shows these computations schematically. First rifle 110 is aiming at target 104 along first trajectory 118. The vector comprising first trajectory 118 is defined by its heading 128 and its inclination 130. If the rifle is equipped with an internal rangefinder, then the length of first trajectory 118 will be known and the position of target 104 can be determined from the position of first rifle 110. If no rangefinder is used, then two rifles will need to be trained on the same target and principles of triangulation employed. Using either approach, the system can determine the location of each rifle in three dimensions and the location of each target in three dimensions. The range calculations can then be made using three-dimensional computations.

The present availability of small computers means that all the computational functions described can likewise be performed by basic control box 72 (as shown in FIG. 7). In order to have the computer compute and transmit the firing sequence, the scene commander would set rotary switch 76 to "Auto Fire" and set each of the four auto fire switches 88 to the "on" position. Of course, the scene commander would not have the benefit of the video display and the menu-driven interface. The parameters would have to be set by downloading code into the device, or using other known means (DIP switches and the like). The basic functionality of the device would be the same, however.

The illustrations presented have used rifles firing conventionally-primed ammunition, but this need not be the case. Electrically primed ammunition has been in common use for many years. Small rifles are presently being adapted for its use. The advantages to the present system would be obvious. Rather than using an electromechanical actuator to release a mechanical striker, the system could simply apply a voltage to the electrical primer of an electrically-ignited cartridge. The rest of the system's functionality would be identical.

The communication means employed to convey data between the rifles and the control unit can take many forms. The current state of radio frequency communications makes that technology desirable. Commercially available R/F transmitter/receiver units can be used. Some of the more advanced units allow high-speed data encryption so that unauthorized users cannot obtain the data. These units are also capable of filtering out unwanted electromagnetic interference in order to provide enhanced security and safety.

If the distances between the units are not too great, simple electrical conductors can be used. These can be analog conductors or a digital data bus. More advanced technologies can be used if electromagnetic interference is a concern. Those skilled in the art will know that most electronic communications equipment is susceptible to electromagnetic interference—at least to some degree. A sophisticated foe may even employ "jamming" devices to disturb the data communications. In such a case, fiber optic cables can be used to transmit the data. Such cables are light and flexible, and are virtually impervious to outside interference. Those skilled in the art will know that towed optical wires have been used to carry data transmissions over several kilometers (in the case of U.S. Army anti-tank missiles). Thus, such cables can be reliably employed in the present invention.

Current technology also allows the use of optical data transmission without cables. A line-of-sight transmitter and receiver pair can be fixed in position. An optical transmitter then sends pulses of light to an optical receiver. Such systems can handle high data transmission rates. Other technologies can obviously be employed. Though the communication means selected must satisfy the practical needs of the invention, it should not be viewed as critical.

The preceding descriptions contain significant detail regarding the novel aspects of the present invention. They should not be construed, however, as limiting the scope of the invention but rather as providing illustrations of the preferred embodiments of the invention. As an example, although R/F communications have been described, hard wires could be used to practice the invention. Thus, the scope of the invention should be fixed by the following claims, rather than by the examples given.

Having described my invention, I claim:

1. A weapon firing system for firing a plurality of independently aimed weapons in a firing sequence in order to cause a plurality of projectiles fired by said plurality of independently aimed weapons to strike at least one target in a specified striking sequence, comprising:
   a. a plurality of weapons, each having
      i. a remotely operable firing mechanism,
      ii. weapon locating means, capable of accurately determining a position for said weapon,
      iii. communication means, capable of transmitting data regarding said position of said weapon, and capable of receiving commands sent to said weapon;
   b. target locating means, capable of accurately determining a position for said at least one target;
   c. a control unit having
      i. communication means, capable of receiving said data regarding said position of each of said weapons from said plurality of weapons and capable of transmitting weapon-specific fire commands to said plurality of weapons,
      ii. computation means, capable of computing
         a distance from each of said weapons to a target of said at least one target designated for each of said weapons,
         a time-in-flight for each of said plurality of projectiles, and
         said firing sequence for said plurality of weapons which will result in said specified striking sequence.

2. A weapon firing system as recited in claim 1, wherein said communication means is selected from the group comprising radio frequency transmitters/receivers, electrical cables, data buses, optical cables, and cable-free optical transmitters/receivers.

3. A weapon system as recited in claim 1, further comprising:
   a. a videoscope on each of said plurality of weapons, capable of delivering an electronic image to said communication means on each of said plurality of weapons; and
   b. wherein said communication means on each of said plurality of weapons is capable of transmitting said electronic image to said control unit, so that said electronic image can be displayed and viewed at said control unit.

4. A weapon firing system as recited in claim 3, wherein said communication means is selected from the group comprising radio frequency transmitters/receivers, electrical cables, data buses, optical cables, and cable-free optical transmitters/receivers.

5. A weapon firing system as recited in claim 1, wherein said target locating means comprises:
   a. heading sensing means mounted on each of said plurality of weapons, capable of accurately determining a heading for each particular weapon;
   b. wherein said communication means on each of said plurality of weapons is capable of transmitting said heading; and
   c. wherein said computation means computes said position for a designated target of said at least one target by using a first position for a first weapon trained upon said designated target, a first heading for said first weapon, a second position for a second weapon trained on said designated target, a second heading for said second weapon, and principles of triangulation.

6. A weapon firing system as recited in claim 5, wherein said communication means is selected from the group comprising radio frequency transmitters/receivers, electrical cables, data buses, optical cables, and cable-free optical transmitters/receivers.

7. A weapon firing system as recited in claim 5, wherein said target locating means further comprises:

a. inclination sensing means mounted on each of said plurality of weapons, capable of accurately determining an inclination for each particular weapon;

b. wherein said communication means on each of said plurality of weapons is capable of transmitting said inclination; and c. wherein said computation means computes said position for a designated target of said at least one target by using a first position for a first weapon trained upon said designated target, a first heading for said first weapon, a first inclination for said first weapon, a second position for a second weapon trained on said designated target, a second heading for said second weapon, a second inclination for said second weapon, and principles of triangulation.

8. A weapon firing system as recited in claim 7, wherein said communication means is selected from the group comprising radio frequency transmitters/receivers, electrical cables, data buses, optical cables, and cable-free optical transmitters/receivers.

9. A weapon system as recited in claim 1, wherein:

a. each of said plurality of weapons further comprises a trigger movable between an undepressed position and a depressed position;

b. said communication means on each of said plurality of weapons is capable of transmitting said position of said trigger; and c. said firing sequence will not be transmitted by said communication means in said control unit until said position of all of said triggers for all of said plurality of weapons matches a predetermined criterion for said position of all of said triggers.

10. A weapon firing system as recited in claim 9, wherein said communication means is selected from the group comprising radio frequency transmitters/receivers, electrical cables, data buses, optical cables, and cable-free optical transmitters/receivers.

11. A weapon system as recited in claim 9, wherein said control unit visually displays said position of said trigger for at least one of said plurality of weapons.

12. A weapon firing system as recited in claim 11, wherein said communication means is selected from the group comprising radio frequency transmitters/receivers, electrical cables, data buses, optical cables, and cable-free optical transmitters/receivers.

13. A weapon firing system for firing a plurality of independently aimed weapons in a firing sequence in order to cause a plurality of projectiles fired by said plurality of independently aimed weapons to strike at least one target in a specified striking sequence, comprising:

a. a plurality of weapons, each having i. a remotely operable firing mechanism, ii. weapon locating means, capable of accurately determining a position for said weapon, iii. a rangefinder, capable of accurately determining a range from said weapon to a designated target of said at least one target, iv. communication means, capable of transmitting data regarding said position of said weapon and said range from said weapon to said designated target, and capable of receiving commands sent to said weapon;

b. a control unit having i. communication means, capable of receiving said data regarding said position of each of said weapons from said plurality of weapons and said data regarding said range to said designated target, wherein said communication means is capable of transmitting weapon-specific fire commands to said plurality of weapons, ii. computation means, capable of computing a time-in-flight for each of said plurality of projectiles, and said firing sequence for said plurality of weapons which will result in said specified striking sequence.

14. A weapon firing system as recited in claim 13, wherein said communication means is selected from the group comprising radio frequency transmitters/receivers, electrical cables, data buses, optical cables, and cable-free optical transmitters/receivers.

15. A weapon system as recited in claim 13, further comprising:

a. a videoscope on each of said plurality of weapons, capable of delivering an electronic image to said communication means on each of said plurality of weapons; and b. wherein said communication means on each of said plurality of weapons is capable of transmitting said electronic image to said control unit, so that said electronic image can be displayed and viewed at said control unit.

16. A weapon firing system as recited in claim 15, wherein said communication means is selected from the group comprising radio frequency transmitters/receivers, electrical cables, data buses, optical cables, and cable-free optical transmitters/receivers.

17. A weapon firing system as recited in claim 13, further comprising:

a. inclination sensing means mounted on each of said plurality of weapons, capable of accurately determining an inclination for each particular weapon;

b. wherein said communication means on each of said plurality of weapons is capable of transmitting said inclination; and c. wherein said computation means adjusts said time-in-flight computations for each of said plurality of weapons according to said inclination for each weapon.

18. A weapon firing system as recited in claim 17, wherein said communication means is selected from the group comprising radio frequency transmitters/receivers, electrical cables, data buses, optical cables, and cable-free optical transmitters/receivers.

19. A weapon system as recited in claim 13, wherein:

a. each of said plurality of weapons further comprises a trigger movable between an undepressed position and a depressed position;

b. said communication means on each of said plurality of weapons is capable of transmitting said position of said trigger; and c. said firing sequence will not be transmitted by said communication means in said control unit until said position of all of said triggers for all of said plurality of weapons matches a predetermined criterion for said position of all of said triggers.

20. A weapon firing system as recited in claim 19, wherein said communication means is selected from the group comprising radio frequency transmitters/receivers, electrical cables, data buses, optical cables, and cable-free optical transmitters/receivers.

21. A weapon system as recited in claim 19, wherein said control unit visually displays said position of said trigger for at least one of said plurality of weapons.

22. A weapon firing system as recited in claim 21, wherein said communication means is selected from the group comprising radio frequency transmitters/receivers, electrical cables, data buses, optical cables, and cable-free optical transmitters/receivers.

* * * * *